United States Patent [19]

Minamiyama et al.

[11] Patent Number: 4,785,693

[45] Date of Patent: Nov. 22, 1988

[54] HYDRAULIC TORQUE WRENCH

[75] Inventors: Toshimasa Minamiyama; Masaaki Ohkubo; Isao Tomioka, all of Osaka, Japan

[73] Assignee: Fuji Kuuki Kabushiki Kaisha, Osaka, Japan

[21] Appl. No.: 78,936

[22] Filed: Jul. 29, 1987

[30] Foreign Application Priority Data

Jul. 30, 1986 [JP] Japan ..... 61-117089[U]

[51] Int. Cl.[4] ..... B25B 19/00

[52] U.S. Cl. ..... 81/465; 464/25; 173/93.5

[58] Field of Search ..... 81/463–466; 173/93, 93.5; 464/24, 25

[56] References Cited

U.S. PATENT DOCUMENTS 4,553,948 11/1985 Tatsuno ..... 464/25

*Primary Examiner*—James G. Smith

*Attorney, Agent, or Firm*—Armstrong, Nikaido, Marmelstein & Kubovcik

[57] ABSTRACT

A communication passageway is formed to extend from the end surface of a cover member opposed to the axial end surface of the shoulder portion of a main shaft and through the main shaft so that in only one of the two particular phase conditions obtained per revolution of an oil cylinder, it establishes the communication between high and low pressure chambers to thereby equalize their pressures.

The communication passageway establishes the communication between high and low pressure chambers in only one of the two particular phase conditions obtained per revolution of the oil cylinder and makes it possible to produce percussion torque in the other particular phase condition.

4 Claims, 6 Drawing Sheets

HYDRAULIC TORQUE WRENCH

BACKGROUND OF THE INVENTION

The present invention relates to a hydraulic torque wrench for tightening such fasteners as bolts and nuts.

A conventional hydraulic torque wrench comprises (a) a rotor driven for rotation, (b) an oil cylinder operatively connected to said rotor, (c) a main shaft installed for relative rotation in said oil cylinder, (d) two blades disposed about 180 degrees out of phase from each other circumferentially of said main shaft and retractably urged radially outwardly of said main shaft, (e) main shaft seal surfaces formed on the outer peripheral surface of said main shaft and circumferentially disposed about 90 degrees out of phase from said blades, (f) first seal surfaces formed on the inner peripheral surface of said oil cylinder so that they oil-tightly contact only said main shaft seal surfaces in a particular phase, (g) second seal surfaces formed on the inner peripheral surface of said oil cylinder so that they oil-tightly contact the projecting ends of said blades in said particular phase, wherein in said particular phase, one side of each of said blades defines a high pressure chamber while the other side defines a low pressure chamber.

In this type of hydraulic torque wrench, high and low pressure chambers are defined for every 180 degrees per revolution of the oil cylinder, so that percussion torque is produced twice per revolution of the oil cylinder. FIGS. 10*a* and 10*b* are cross-sectional views for explaining how percussion torque is produced in such torque wrench. As shown in FIG. 10*a*, two blades 102 are disposed about 180 degrees out of phase from each other circumferentially of a main shaft 101 and retractably urged radially outwardly of the main shaft 101. Seal surfaces 101*a* are formed at positions deviated some degrees toward one blade 102 (the lower blade 102 in the figure) from an axis a perpendicularly intersecting a line connecting blade receiving grooves S which receive the blades 102. The seal surfaces 101*a* slightly project radially outward from the outer peripheral surface of the main shaft 101.

On the other hand, the oil cylinder 103 has a cylinder chamber of cocoon-shaped cross section. The inner surface of the oil cylinder 103 has two second seal surfaces 103*b* formed thereon at diametrically opposite positions on its major axis. At diametrically opposite positions on its minor axis it is formed with two first seal surfaces 103*a*. The second seal surfaces 103*b* are adapted to contact the front surfaces of the blades 102, while the first seal surfaces 103*a* are adapted to contact the main shaft seal surfaces 101*a*. The first seal surfaces 103*a* are deviated some degrees from the direction of said minor axis in the same relationship as between the blades 102 and the main shaft seal surfaces 101*a*.

Thus, as shown in FIG. 10*a*, in a first particular phase condition in which the second seal surfaces 103*b* are contacted by the blades 102 and the first seal surface 103*a* are contacted by the main shaft seal surfaces 101*a*, high pressure chambers H and low pressure chambers L are alternately defined circumferentially of the main shaft 101. In a second particular phase condition established when the oil cylinder 103 has rotated through 180 degrees relative to the main shaft 101 from said first particular phase condition, as shown in FIG. 10*b*, the second seal surfaces 103*b* are contacted by the blades 102, but the first seal surfaces 103*a* and the main shaft seal surfaces 101*a* do not contact each other, creating a clearance therebetween. Therefore, there is no pressure difference produced and hence said high and low pressure chambers are not defined. In other conditions than these first and second particular phase conditions, no pressure difference is produced; high and low pressure chambers are defined in the first particular phase condition only. That is, percussion torque is produced once per revolution of the oil cylinder 103 relative to the main shaft.

In this conventional example, the arrangement must be such that the main shaft seal surfaces 101*a* and the first seal surfaces 103*a* are switched between contact and noncontact conditions by a slight clearance therebetween attending on 180-degree relative rotation and such that in the noncontact condition, communication clearances are defined between the main shaft seal surfaces 101*a* and the inner peripheral surface of the oil cylinder 103 and between the first seal surfaces 103*a* and the outer peripheral surface of the main shaft 101. Therefore, the processing of the main shaft seal surfaces 101*a* and the first seal surfaces 103*a* requires high precision, which, in turn, requires much time and labor in processing, leading to high cost.

OBJECT OF THE INVENTION

An object of the invention is to provide a hydraulic torque wrench which is easy to process and inexpensive in that the arrangement for establishing the communication between the high and low pressure chambers only in one of the two particular phase conditions established per revolution of the oil cylinder is obtained without requiring high precision.

SUMMARY OF THE INVENTION

A hydraulic torque wrench according to the invention comprises (a) a rotor driven for rotation, (b) an oil cylinder operatively connected to said rotor, (c) a main shaft installed for relative rotation in said oil cylinder, (d) two blades disposed about 180 degrees out of phase from each other circumferentially of said main shaft and retractably urged radially outwardly of said main shaft, (e) main shaft seal surfaces formed on the outer peripheral surface of said main shaft and circumferentially disposed about 90 degrees out of phase from said blades, (f) first seal surfaces formed on the inner peripheral surface of said oil cylinder so that they oil-tightly contact only said main shaft seal surfaces in a particular phase, (g) second seal surfaces formed on the inner peripheral surface of said oil cylinder so that they oil-tightly contact the projecting ends of said blades in said particular phase, wherein in said particular phase, one side of each of said blades defines a high pressure chamber while the other side defines a low pressure chamber, and (h) a communication passageway extending from the end surface of a cover member for said oil cylinder contacting the axial en surface of the shoulder portion of said main shaft to said main shaft so that in only one of said two particular phase conditions obtained per revolution of said oil cylinder, said communication passageway establishes the communication between said high and low pressure chambers to thereby equalize their pressures.

In only one of the two particular phase conditions obtained per revolution of the main shaft, such communication passageway establishes the communication between the high and low pressure chambers, so that in the other particular phase condition, percussion torque can be produced.

In a preferred embodiment of the invention, said communication passageway comprises notched grooves formed in the end surface of said cover member in such a manner as to be opposed to the high and low pressure chambers, and communication holes formed in the main shaft in such a manner as to open to the axial end surface of the shoulder portion of said main shaft. In another embodiment, the communication passageway comprises notched grooves formed in the end surface of said cover member in a such a manner as to be opposed to the high and low pressure chambers, and notched grooves formed in the axial end surface of the shoulder portion of said main shaft. In a further embodiment of the invention, said communication passageway comprises communication holes formed in said cover member in such a manner as to open to the end surface of said cover member, and communication holes formed in the main shaft in such a manner as to open to the axial end surface and outer peripheral surface of the shoulder portion of the main shaft.

DETAILED DESCRIPTION

First Embodiment

Figure 1:
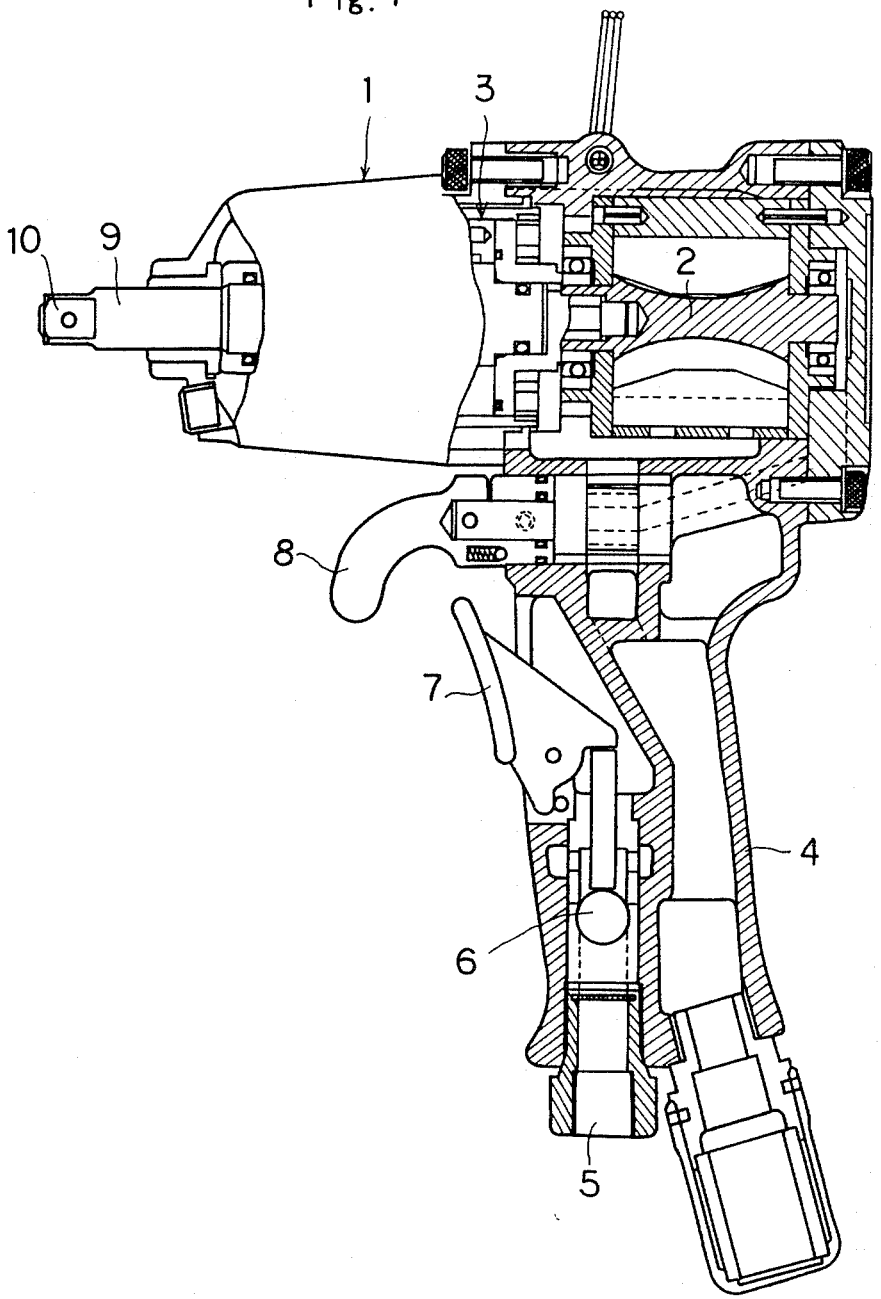
FIG. 1 is a side view, partly broken away, of a first embodiment of a hydraulic torque wrench according to the invention.

In FIG. 1, the numeral 1 denotes a wrench body, with a rotor 2 rotatably installed in the rear upper region of the wrench body 1. An oil cylinder 3 is rotatably installed in the front upper region of the wrench body 1. The grip portion 4 of the wrench body 1 has an air feed port 5, a valve lever 7 for operating a main valve 6 which opens and closes an air passageway leading from said air feed port 5 to the rotor 2, and a rotary switching lever 8 for changing the direction of air feed to the rotor 2 so as to change the direction of rotation of the rotor 2.

A main shaft 9 is rotatably supported and projects beyond the front end of the wrench body 1, the front end of said main shaft 9 being provided with an attachment 10 for removably attaching thereto various tools of different diameters.

Figure 2:
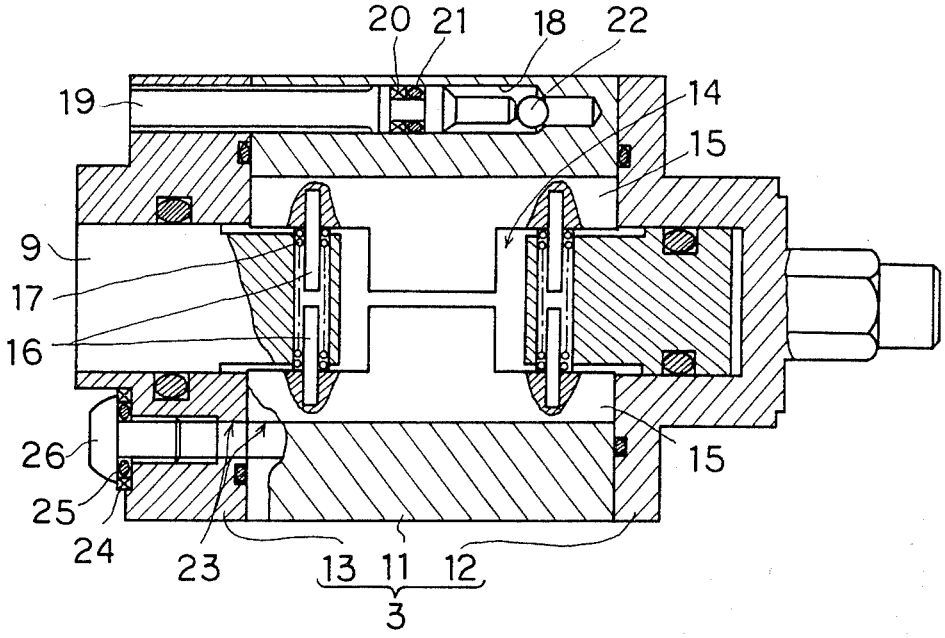
FIG. 2 is an enlarged longitudinal sectional view of the main portion of FIG. 1.

The oil cylinder 3, as shown in FIG. 2, comprises a cylindrical cylinder body 11 having upper and lower covers 12 and 13 integrally connected thereto. The upper cover 12 is connected to the rotor 2 for integral rotation with the latter, while the lower cover 13 rotatably supports the main shaft 3, the latter extending through said lower cover 13.

Figure 4:
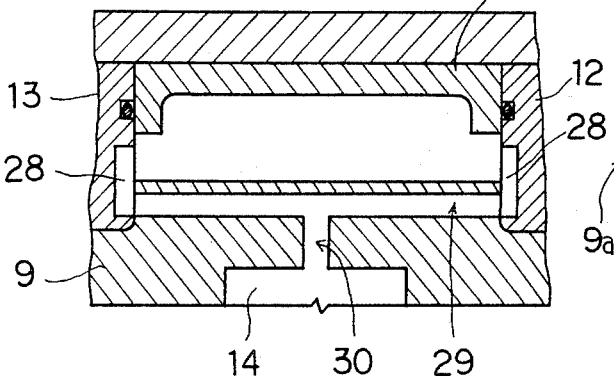
FIG. 4 is a longitudinal sectional view of the main portion, showing a communication passageway.

The portion of said main shaft 9 which is located in the cylinder body 11 is formed with a blade receiving groove 14, as shown in FIGS. 2 and 4. Two blades 15 are inserted in said blade receiving groove 14 from opposite sides so that said blades are movable radially of the main shaft 4. Spring guide pins 16 and compression coil springs 17 are interposed between the two blades 15, thereby urging the blades 15 to move away from each other radially outwardly of the main shaft 9.

Figure 5:
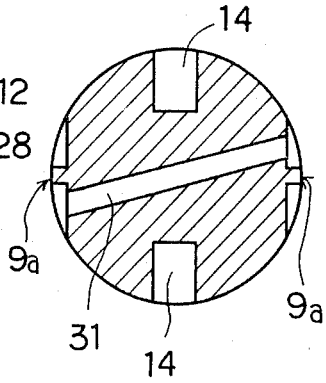
FIG. 5 is a cross-sectional view for explaining a third communication hole.

The regions of the outer peripheral surface of the main shaft 9 circumferentially spaced about 90 degrees from said blades are formed with main shaft seal surfaces 9*a*, as shown in FIG. 5.

Figure 3A:
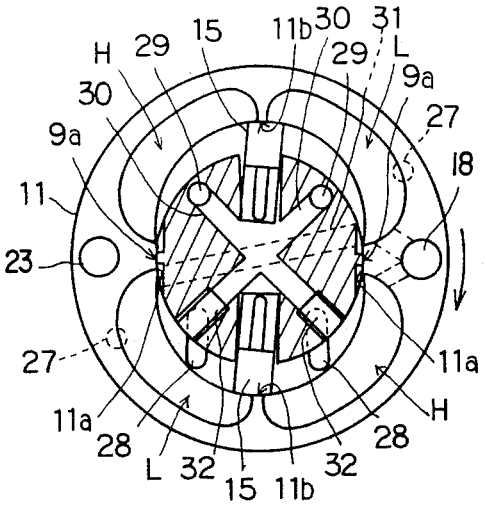
FIGS. 3*a* through 3*d* cross sectional views of an oil cylinder, showing how percussion torque is produced.

As shown in FIG. 3*a*, the interior of the cylinder body 11 is cocoon-shaped in cross-section. The inner peripheral surface of the cylinder body 11 is formed with first seal surfaces 11*a* and second seal surfaces 11*b*. The first seal surfaces 11*a* are adapted to oil-tightly contact only the main shaft seal surfaces 9*a*, while the second seal surfaces 11*b* are adapted to oil-tightly contact the projecting ends of the blades 15.

As shown in FIG. 2, an oil pressure adjusting hole 18 is formed which extends from the cylinder body 11 across the lower cover 13. Installed in the oil pressure adjusting hole 18 through an oil pressure adjusting screw 19, a backup ring 20 and a sealing 0-ring 21 is a ball valve 22 serving as a relief valve. Thus, adjusting the oil pressure adjusting screw 19 adjusts the flow rate of oil escaping from high pressure chambers H to low pressure chambers L during production of percussion torque, whereby a predetermined percussion torque is obtained.

An oil feed port 23 is formed which extends from the cylinder body 11 across the lower cover 13. The oil feed hole 23 in the lower cover 13 has an oil feed plug 26 attached thereto through a seal ring 24 and an O-ring 25.

In FIG. 3*a*, the numeral 27 denotes knock pins for attaching the cylinder body 11 and upper and lower covers 12 and 13 together in the properly positioned state.

At two predetermined places on the end surfaces of the upper and lower covers 12 and 13, notched grooves 28 extending axially outwardly of the main shaft 9 are formed by end milling, as shown in FIGS. 3*a* and 4.

On the other hand, the main shaft 9 is formed with two first communication holes 29 by drilling so that they open to the opposite axial end surfaces of the shoulder of the main shaft 9. The openings of the first communication holes 29 are positioned so that they are opposed to said notched grooves 28 in, of first and second particular phase conditions established per revolution of the oil cylinder 3 relative to the main shaft 3 in which the main shaft seal surfaces 9*a* contact the first seal surfaces 11*a* (see FIGS. 3*a* and 3*c*), the second particular phase condition (see FIG. 3*c*). Further, the main shaft 9 is formed with second communication holes 30 by drilling, as shown in FIG. 3*a*. In said second particular phase condition, the second communication holes 30 establish the radial communication between the first communication holes 29 and the central region of the blade receiving groove 14. The main shaft 9 is formed with a third communication hole 31 by drilling, as shown in FIG. 5. The third communication hole 31 extends through the center of the main shaft 9 and through the regions thereof adjacent the main shaft seal surfaces 9*a*. The third communication hole 31 is drilled at a position not communicating with said blade receiving groove 14, that is, a position on the main shaft 9 adjacent the lower cover 13. The numeral 32 in FIG. 3*a* denotes plugs for closing the open ends of the second communication holes 30 to define such second communication holes.

Figure 3B:
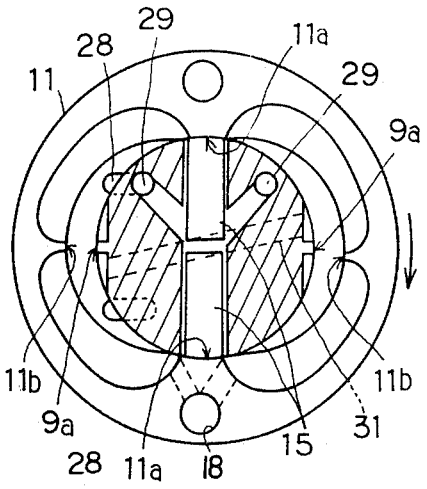
Figure 3C:
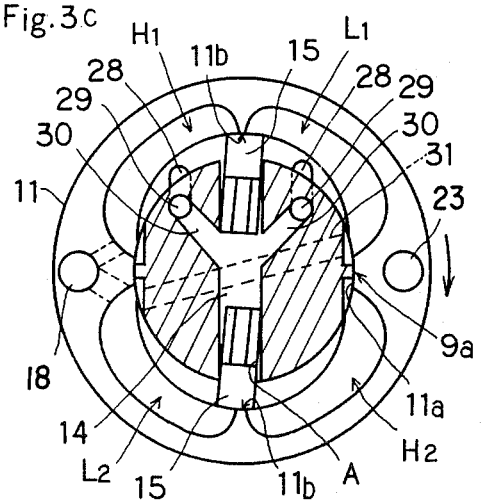

With the arrangement made in the manner described above, the first particular phase condition is established once per revolution of the oil cylinder 3 relative to the main shaft 9, in which as shown in FIG. 3*a* the main shaft seal surfaces 9*a* contact the first seal surfaces 11*a* while the projecting ends of the two blades 15 contact the second seal surfaces 11*b* but the notched grooves 28 do not communicate with the first communication holes 29. Such oil-tight arrangement defines high pressure chambers H and low pressure chambers L, and application of oil pressure to the two blades 15 generates percussion torque. In a condition established when the oil cylinder 3 has rotated through 90 degrees, as shown in FIG. 3*b*, the main shaft seal surfaces 9*a* are separated from the second seal surfaces 11*b*, so that no high pressure chambers H are defined. In a condition 90 degrees rotatively away therefrom, as shown in FIG. 3*c*, the second particular phase condition is established in which the main shaft seal surfaces 9*a* contact the first seal surfaces 11*a* while the projecting ends of the two blades 15 contact the second seal surfaces 11*b* but the function of said notched grooves 28 and first through third communication holes 29, 30 and 31 causes spaces corresponding to high and low pressure chambers H and L to communicate with each other for pressure equalization. This is because, in FIG. 3*c*, the first high pressure chamber H1 and the second low pressure chamber L1 communicate with each other through the notched grooves 28, the first and second communication holes 29 and 30 and the blade receiving groove 14 while the first and second high pressure chambers H1 and H2 communicate with each other through the notched groove 28, the first and second communication holes 29 and 30 and a clearance A between the inner wall surface of the blade receiving groove 14 and the lateral surface of the blade 14 and because the first and second low pressure chambers L1 and L2 communicate with each other through the third communication hole 31. Therefore, in the second particular phase condition, no percussion torque is produced.

Figure 3D:
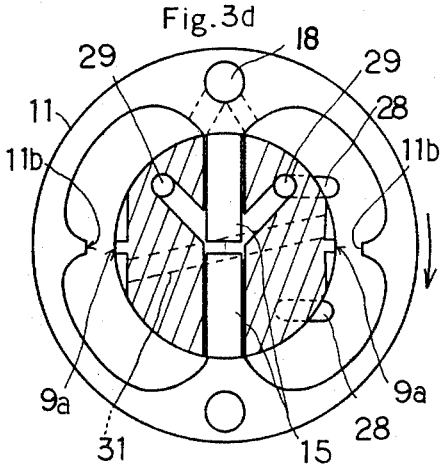

In a condition 90 degrees rotatively away from said second particular phase condition, as shown in FIG. 3*d*, since the main shaft seal surfaces 9*a* are separated from the second seal surfaces 11*b*, no high pressure chambers H are defined.

The arrangement comprising the notched grooves 28 and the first through third communication holes 29, 30 and 31 for effecting pressure equalization by establishing the communication between the high and low pressure chambers in said second particular phase condition (see FIG. 3*c*) will be collectively referred to as a communication passageway.

Second Embodiment

Figure 6:
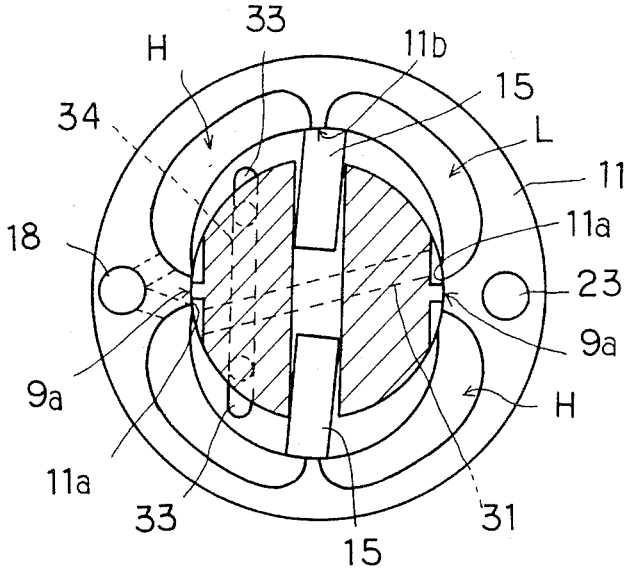
FIG. 6 is a cross-sectional view of an oil cylinder in a second embodiment of a hydraulic torque wrench according to the invention.
Figure 7:
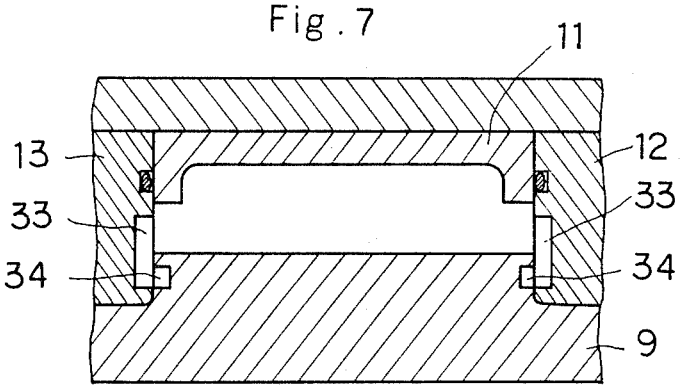
FIG. 7 is a longitudinal sectional view showing a communication passageway in said second embodiment.
Figure 8:
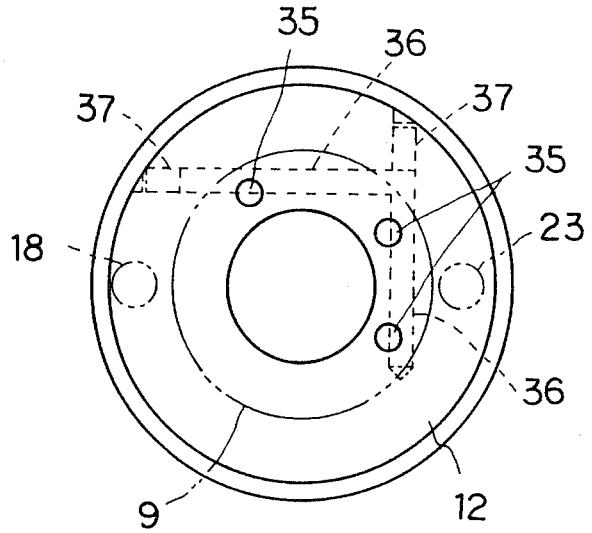
FIG. 8 is an end view of an upper cover in a third embodiment of a hydraulic torque wrench according to the invention.
Figure 9:
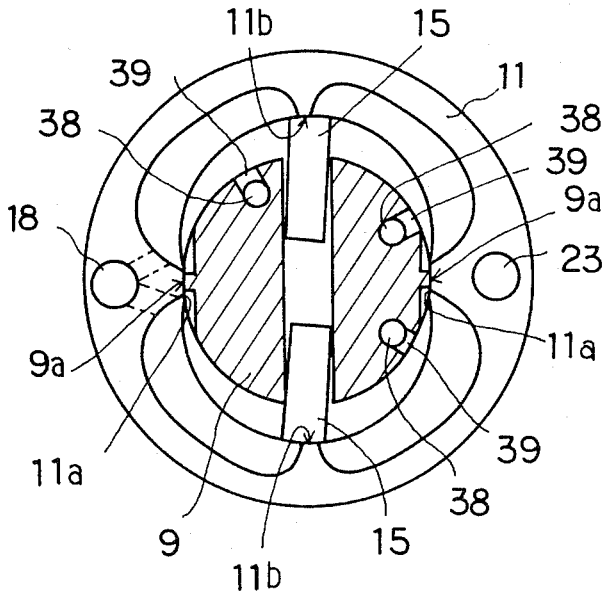
FIG. 9 is a cross-sectional view of a main shaft in said third embodiment.
Figure 10A:
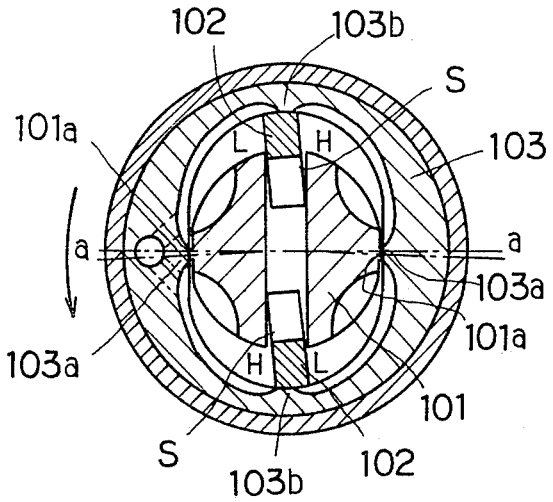
Fig.10a (PRIOR ART)
FIGS. 10*a* and 10*b* are cross-sectional views of a conventional example.
Figure 10B:
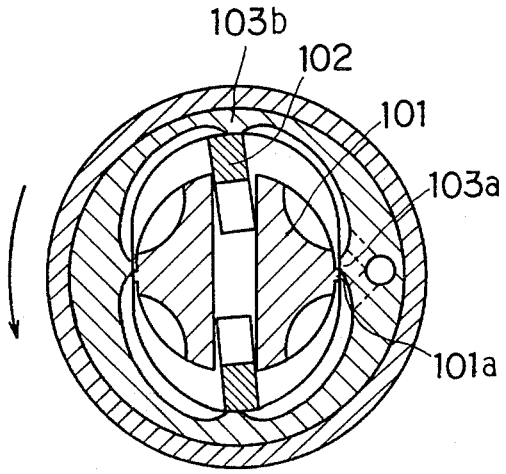
Fig.10b (PRIOR ART)

As shown in FIGS. 6 and 7, the end surfaces of the upper and lower covers 12 and 13 opposed to the blades 15 are formed with notched grooves 33. On the other hand, the axial end surfaces of the shoulder portion of the 34 which establish the communication between the two notched grooves 33 in said second particular phase condition. As in the first embodiment, a third communication hole 31 is formed in the main shaft 9. The notched grooves 33, main shaft notched-grooves 34 and third communication hole 31 form a communication passageway. In said first particular phase condition, high and low pressure chambers H and L can be defined in that the notched grooves 33 are positioned on the side opposite to the main shaft notched-grooves 34 with the blade receiving groove 14 interposed therebetween, but in the second particular phase condition, they communicate with each other for pressure equalization. Third Embodiment As shown in FIGS. 8 and 9, fourth communication holes 35 are formed in the upper and lower covers 12 and 13 so that they have openings at three circumferentially spaced places thereon opposed to the axial end surfaces of the shoulder portion of the main shaft 9. Each of the upper and lower covers 12 and 13 is internally formed with two fifth communication holes 36 which connect the fourth communication holes 35. In FIG. 8, the numeral 37 denotes hole closing plugs. On the other hand, the main shaft 9 is formed with three sixth communication holes 38 extending axially therethrough so that they are opposed to the open ends of said fourth communication holes 35 in said second particular phase condition.

Seventh communication holes 39 is formed which extends from the sixth communication holes 38 to the outer peripheral surface of the main shaft 9. The fourth through seventh communication holes 35, 36, 38 and 39 form a communication passageway. In the second particular phase condition, said communication passageway establishes the communication between the high and low pressure chambers H and L for pressure equalization.

In the present invention, in forming a communication passageway, it is possible to use only either the upper cover 12 or the lower cover 13 rather than using both; thus, the term "cover member" used herein refers to the upper cover 12 or the lower cover 13 or both the upper and lower covers 12 and 13 collectively.

As has so far been described, according to the invention, in the cover member, it is only necessary to form, by end milling or drilling, notched grooves in the end surface thereof or communication holes which open to the end surface thereof, while in the main shaft, it is only necessary to form, by end milling or drilling, communication holes which open to the axial end surface of the shoulder portion thereof or notched grooves in the axial end surface of the shoulder portion thereof, so as to form a communication passageway. As to the main shaft seal surfaces and the second seal surfaces, which contact each other, there is no need for slight deviation of phase; rather, it is only necessary to ensure that these seal surfaces fully contact each other in the particular phase condition in which they are 180 degrees out of phase form each other. The construction for easily and reliably connecting the high and low pressure chambers in only one of the two particular phase conditions obtained per revolution of the oil cylinder relative to the main shaft can be realized without requiring high precision. Therefore, a hydraulic torque wrench which is capable of producing percussion torque once per revolution of the oil cylinder relative to the main shaft can be provided at low cost without requiring complicated processing.

What is claimed is:

1. A hydraulic torque wrench comprising:

(a) a rotor driven for rotation, (b) an oil cylinder operatively connected to said rotor, said oil cylinder having a cove at least one end thereof, (c) a main shaft installed for relative rotation in said oil cylinder, said main shaft having a shoulder portion, (d) two blades disposed about 180 degrees out of phase from each other circumferentially of said main shaft and retractably urged radially outwardly of said main shaft, (e) main shaft seal surfaces formed on the outer peripheral surface of said main shaft and circumferentially disposed about 90 degrees out of phase from said blades, (f) first seal surfaces formed on the inner peripheral surface of said oil cylinder so that they oil-tightly contact said main shaft seal surfaces in only two particular phase conditions obtained during each revolution of said oil cylinder, (g) second seal surfaces formed on the inner peripheral surface of said oil cylinder so that they oil-tightly contact the projecting ends of said blades in said two particular phase conditions and wherein one of said particular phase conditions one side of each of said blades defined a high pressure chamber while the other side defines a low pressure chamber, and (h) a communication passageway comprising notched grooves formed in the end surface of a cover member for said oil cylinder contacting the axial end surface of the shoulder portion of said main shaft and communication holes formed in the main shaft and open to the axial end surface of the shoulder portion of said main shaft said notched grooves in the end surface of said cover member being opposed to said high and low pressure chambers so that in the other one of said two particular phase conditions, said communication passageway establishes communication between said high and low pressure chambers to thereby equalize their pressures.

2. A hydraulic torque wrench comprising:

(a) a rotor driven for rotation, (b) an oil cylinder operatively connected to said rotor, said oil cylinder having a cover at least one end thereof, (c) a main shaft installed for relative rotation in said oil cylinder, said main shaft having a shoulder portion, (d) two blades disposed about 180 degrees out of phase from each other circumferentially of said main shaft and retractably urged radially outwardly of said main shaft, (e) main shaft seal surfaces formed on the outer peripheral surface of said main shaft and circumferentially disposed about 90 degrees out of phase from said blades, (f) first seal surfaces formed on the inner peripheral surface of said oil cylinder so that they oil-tightly contact said main shaft seal surfaces in only two particular phase conditions obtained during each revolution of said oil cylinder, (g) second seal surfaces formed on the inner peripheral surface of said oil cylinder so that they oil-tightly contact the projecting ends of said blades in said two particular phase conditions and where in one of said particular phase conditions one side of each of said blades defines a high pressure chamber while the other side defines a low pressure chamber, and (h) a communication passageway comprising notched grooves formed in the end surface of a cover member for said oil cylinder contacting the axial end surface of the shoulder portion of said main shaft and notched grooves formed in said axial end surface of the shoulder portion of said main shaft, said notched grooves in the end surface of said cover member being opposed to said high and low pressure chambers so that in the other one of said two particular phase conditions, said communication passageway establishes communication between said high and low pressure chambers to thereby equalize their pressure.

3. A hydraulic torque wrench comprising:

(a) a rotor driven for rotation, (b) an oil cylinder operatively connected to said rotor, said oil cylinder having a cover at least one end thereof, (c) a main shaft installed for relative rotation in said oil cylinder, said main shaft having a shoulder portion, (d) two blades disposed about 180 degrees out of phase from each other circumferentially of said main shaft and retractably urged radially outwardly of said main shaft, (e) main shaft seal surfaces formed on the outer peripheral surface of said main shaft and circumferentially disposed about 90 degrees out of phase from said blades, (f) first seal surfaces formed on the inner peripheral surface of said oil cylinder so that they oil-tightly contact said main shaft seal surfaces in only two particular phase conditions obtained during each revolution of said oil cylinder, (g) second seal surfaces formed on the inner peripheral surface of said oil cylinder so that they oil-tightly contact the projecting ends of said blades in said two particular phase conditions and where in one of said particular phase conditions one side of each of said blades defines a high pressure chamber while the other side defines a low pressure chamber, and (h) a communication passageway comprising communication holes formed in a cover member for said oil cylinder contacting the axial end surface of the shoulder portion of said main shaft and open to an end surface of said cover member contacting said axial end surface of said shoulder portion of said main shaft and communication passages formed in said main shaft and open to said axial end surface of said shoulder portion and to the other peripheral surface of said shoulder portion of said main shaft so that in the other one of said two particular phase conditions, said communication passageway establishes communication between said high and low pressure chambers to thereby equalize their pressures.

4. A hydraulic torque wrench as set forth in claim 3, wherein said communication passages formed in the main shaft comprise communication holes.

* * * * *